US006450400B1

(12) United States Patent
Savoir, Jr.

(10) Patent No.: US 6,450,400 B1
(45) Date of Patent: Sep. 17, 2002

(54) CURRENCY STORAGE DEVICE

(76) Inventor: Roland D. Savoir, Jr., 623 E. Main St., New Britain, CT (US) 06051

( * ) Notice: Subject to any disclaimer, the term of this patent is extended or adjusted under 35 U.S.C. 154(b) by 0 days.

(21) Appl. No.: 09/591,146

(22) Filed: Jun. 9, 2000

(51) Int. Cl.[7] ..... B65D 91/00

(52) U.S. Cl. ..... 232/1 D; 206/37; 206/1.5; 150/143; 220/284; 220/326; 220/345.3; 232/44

(58) Field of Search ..... 232/1 D, 1 R, 232/4 R, 44; 206/1.5, 37, 38; 150/132, 143, 147, 149; 220/210, 284, 326, 345.3, 345.2, 345.1, 601, 661, 676; 109/73

(56) References Cited

U.S. PATENT DOCUMENTS 85,647 A * 1/1869 Dolan ..... 109/73
2,936,189 A * 5/1960 Pearson ..... 292/42
3,888,350 A * 6/1975 Horvath ..... 206/531
4,113,157 A * 9/1978 Woodbury ..... 224/163
4,478,330 A * 10/1984 Lin ..... 206/38
4,775,066 A * 10/1988 Keppeler ..... 220/484
5,082,137 A * 1/1992 Weinstein ..... 220/345.3
5,361,925 A * 11/1994 Wecke et al. ..... 220/325
5,494,158 A * 2/1996 Erickson ..... 206/366
5,806,649 A * 9/1998 Walsh et al. ..... 194/203
5,950,816 A * 9/1999 Reid ..... 206/38.1

* cited by examiner

*Primary Examiner*—Jack Lavinder
*Assistant Examiner*—William L. Miller
(74) *Attorney, Agent, or Firm*—McCormick, Paulding & Huber LLP

(57) ABSTRACT

A portable currency storage device for securing paper currency and the like against immediate access includes a cover and base slideably joined and locked together. A thumbwheel is provided to assist paper currency and the like into an internal compartment of the device, but is unable to withdraw the same. The internal compartment and its contents are accessible only by separating the cover from the base using the key provided for such.

18 Claims, 4 Drawing Sheets

CURRENCY STORAGE DEVICE

FIELD OF THE INVENTION GROUP

This invention relates generally to safes and currency storage devices, and more particularly to portable currency holders accessible by a unique device quite unlike a common key.

BACKGROUND OF THE INVENTION

The rise in popularity of casinos in the United States has highlighted that many recreational gamblers lack the discipline to retain a portion of their winnings while they continue to gamble. Since the long term odds favor the house, it is a fundamental rule of gambling that at least a portion of any winnings be retained and not be put at risk on subsequent wagers. But modern casinos are designed to maintain an atmosphere of gambling excitement, testing the resolve of most recreational gamblers and causing them to continue to risk their winnings, to the casino's long term advantage.

The present invention is directed toward a solution for that lack of discipline. Although currency storage devices for securing paper currency and the like against immediate access by its user are known, there is a need for a device portable enough to be carried discretely in a gambler's pocket, and that is accessible only by a special key, which ideally the gambler leaves at home or at least in a remote location. This disclosure allows a gambler to put a portion of his winnings (converted into currency) into a box where his jackpot is inaccessible. If he should encounter a subsequent losing streak he will be unable to access the winnings secured in the storage device until he returns home.

While the casino application is the most obvious one, the present invention is useful for securing paper currency and the like from others, as well as from the user. Travelers may use it while away from home to hide their cash from hotel chambermaids unaware of the contents of the device. Purse snatchers may discard it with a purloined purse for the same reason, giving the victim a chance at recovering her cash if the purse is found.

SUMMARY OF THE INVENTION

In accordance with the present invention, a portable device for holding paper currency is provided, comprising a base and a cover being moveable relative to one other and defining an interior compartment, a locking mechanism to prevent movement of said base relative to said cover, and escapement means for receiving paper currency and the like into said interior compartment. Separate from the currency holding device but necessary to non-destructively access its contents is a multi-faceted key comprising a body and projections therefrom adapted to disengage said locking mechanism of said currency storage device by depressing retractable pins of said locking mechanism, thus allowing said base and cover to move relative to each other and expose said interior compartment.

In the preferred embodiment described in detail below, the locking mechanism comprises retractable pins in the cover or base, and complementary holes in the other of said cover or base that receive the retractable pins when the cover and base are slideably engaged. The escapement means is a manual thumbwheel and an inlet ramp, each partially extending into a slot, said slot being in communication with both said interior compartment and the exterior of the device.

The thumbwheel and the inlet ramp act in concert to facilitate putting paper currency into the interior compartment through the slot but inhibiting its removal therethrough. The multi-faceted key of the preferred embodiment comprises a body equipped with fixed pins extending therefrom and so positioned as to be received through the holes of the cover to simultaneously urge the retractable pins of the base toward a retracted position, allowing the base and the cover to be slideably disengaged.

BRIEF DESCRIPTION OF THE DRAWINGS

A more complete understanding of the present invention and many of its attendant advantages will be readily appreciated and better understood by reference to the following detailed description when considered in conjunction with the accompanying drawings, wherein.

DETAILED DESCRIPTION OF THE PREFERRED EMBODIMENT

Figure 1:
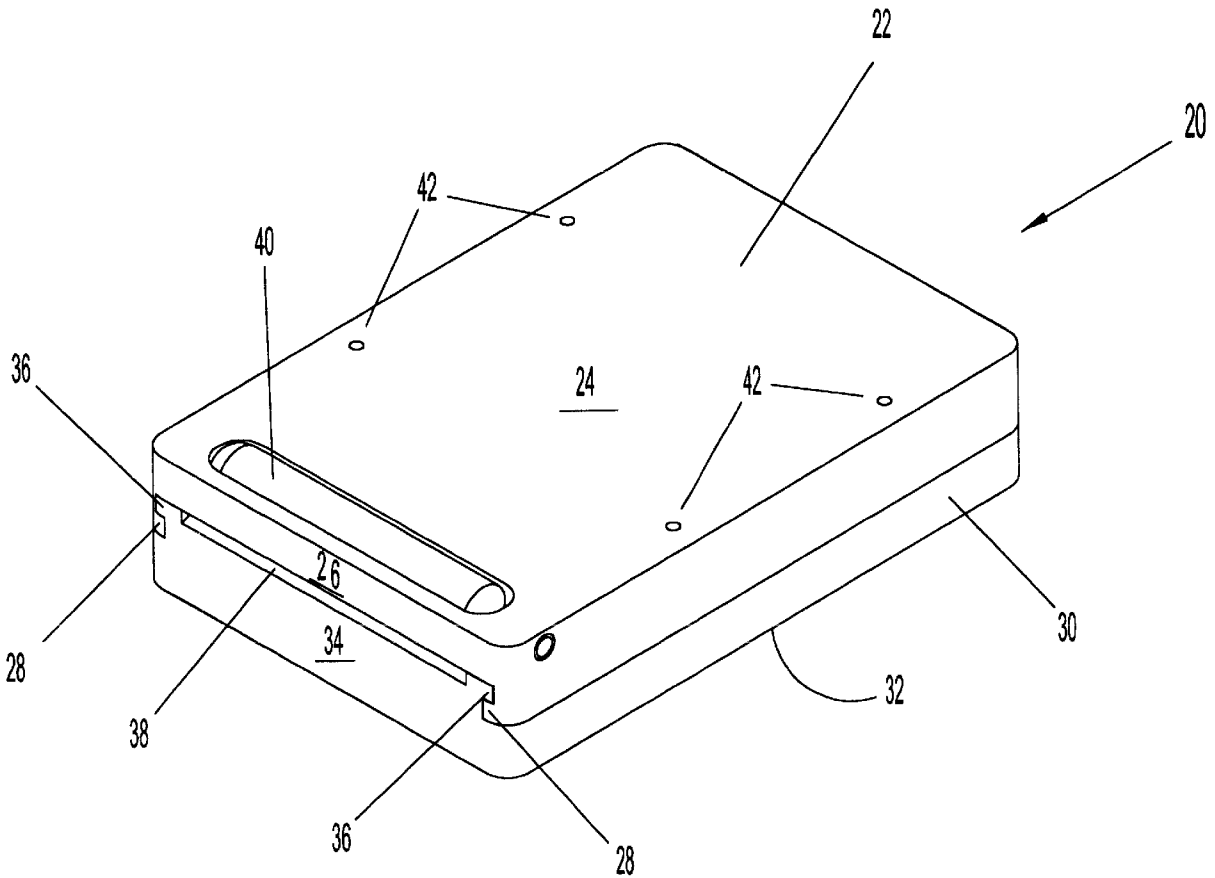
FIG. 1 is a perspective view of the preferred embodiment of the portable currency storage device.

The preferred embodiment of the present invention, depicted in perspective view at FIG. 1 and designated generally as 20, comprises a cover 22 having a cover top surface 24, a cover front surface 26, and projecting tabs 28. A base 30 similarly has a base bottom surface 32, a base front surface 34, and projecting tabs 36. The cover and base projecting tabs, 28 and 36 respectively, are complementary to each other, and interlock to enable the cover 24 and the base 30 to slideably engage each other. When so engaged, the cover and base define an interior compartment shown particularly in FIG. 2 and described below. The interior compartment is designed to accommodate folded currency so that the currency storage device may be discretely carried in a pocket.

The cover 22 and the base 30 define a slot 38 in communication with the interior compartment and the exterior of the currency storage device. Projecting partially through the cover top surface 24 is a thumbwheel 40 for drawing and assisting paper currency into an interior compartment of the portable currency storage device. The cover also defines holes 42 extending therethrough for a purpose to be described below.

Figure 2:
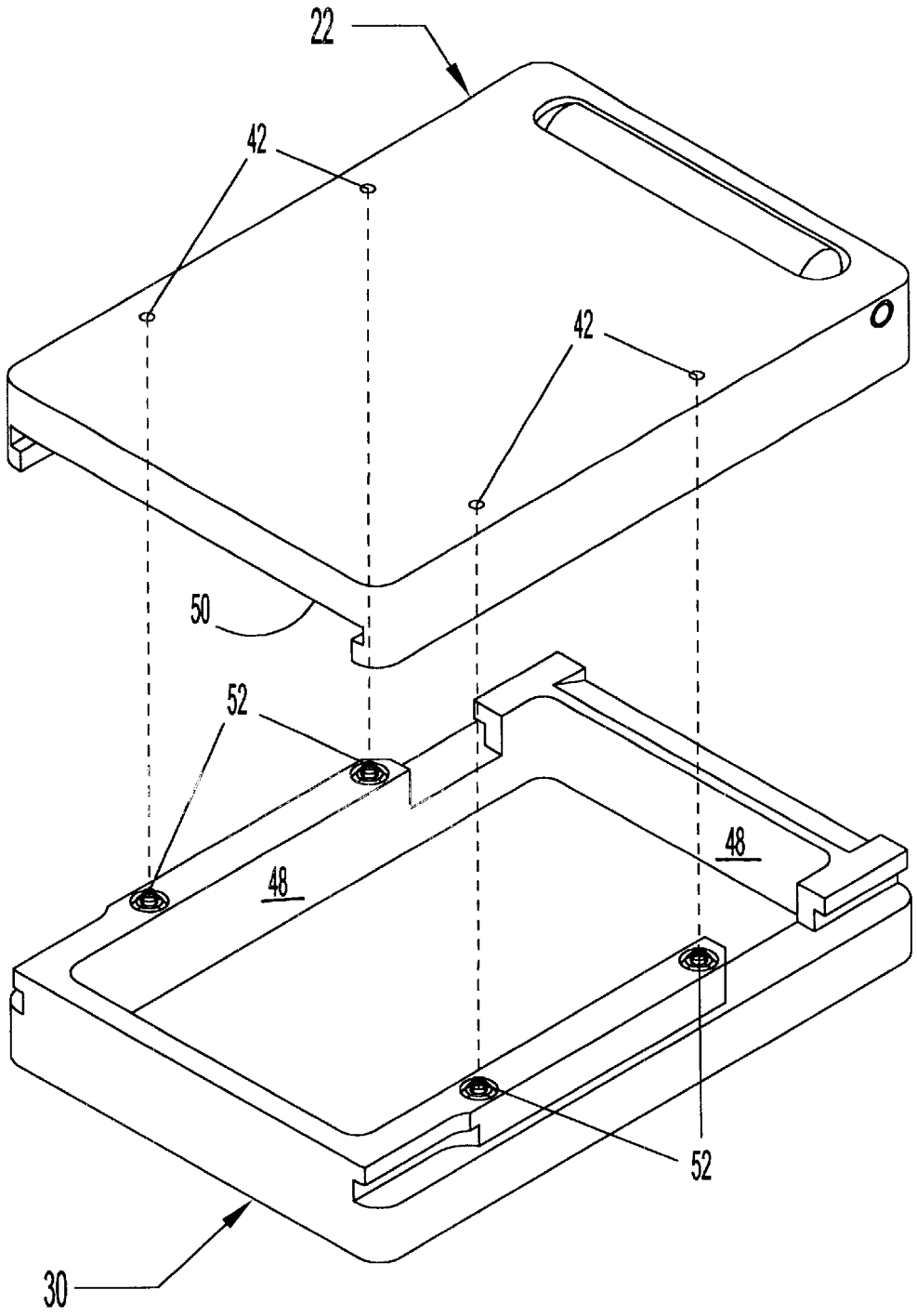
FIG. 2 is an exploded view of the cover and base of FIG. 1.

FIG. 2 shows an exploded view of the cover 22 and base 30, wherein the interior compartment, shown generally at 44, is defined by the base top surface 46, the sidewalls 48, and the cover bottom surface 50. Along the tops of the sidewalls are a plurality of retractable pins 52 that are biased to the extended position (as shown), said retractable pins being aligned with the holes 42 when said cover 22 and said base 30 are slideably engaged. When the cover 22 and the base 30 are fully engaged so that the front surfaces 26 and 34 are flush, the bias of the retractable pins 52 causes them to extend into the holes 42, thus preventing the cover 22 and the base 30 from being slideably disengaged except when said pins 52 are retracted. This retraction is done by a key 54, described below and shown in FIG. 4.

Figure 3:
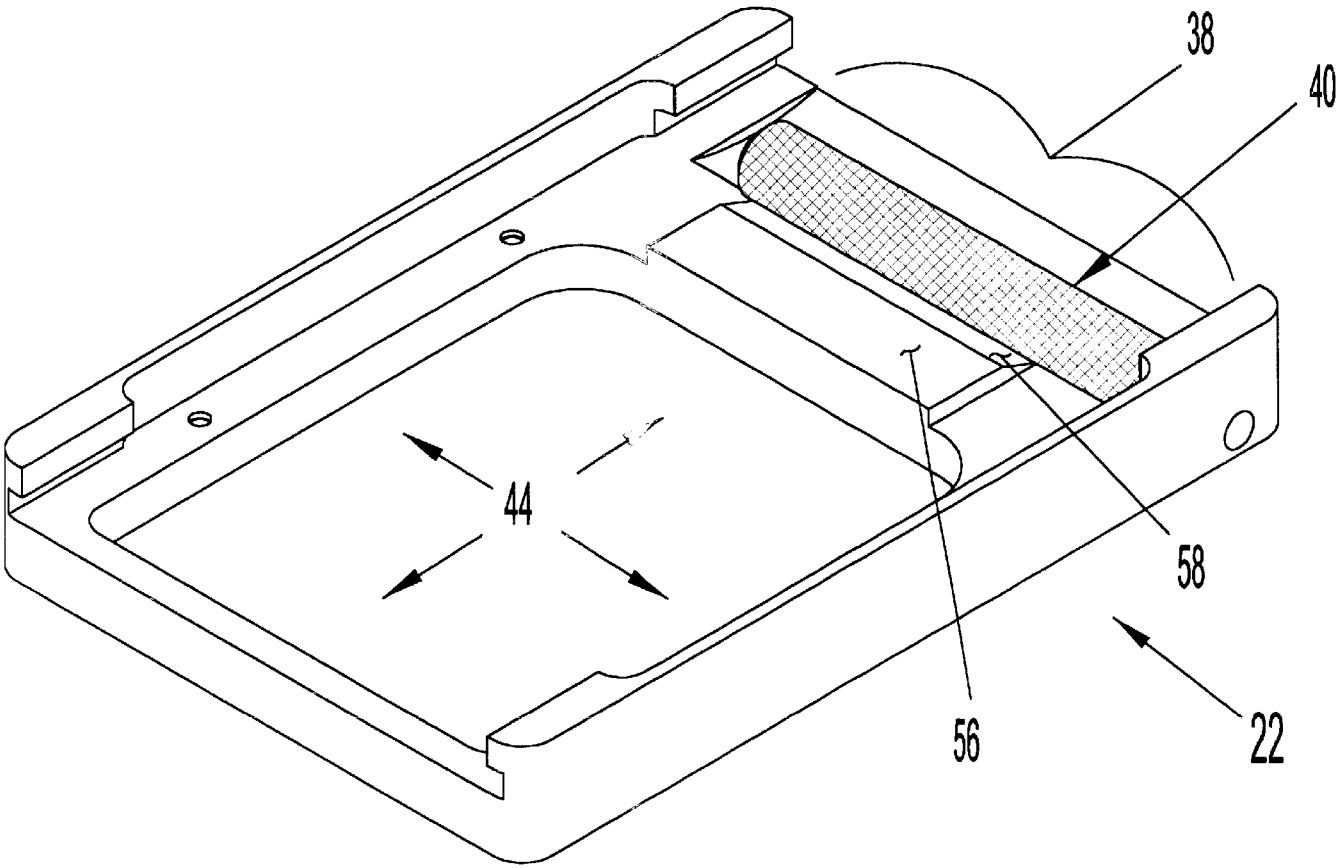
FIG. 3 is a perspective view of the cover of FIG. 1 showing its interior.

The cover 22 is shown in isolation at FIG. 3, in a position inverted from that of FIGS. 1 and 2 to particularly expose the interior of said cover 22. The interior compartment is shown generally at 44. The thumbwheel 40 projects partially into the slot 38. Between the thumbwheel 40 and the interior compartment 44 is an inlet ramp 56 having an inclined segment 58 adjacent to said thumbwheel 40. Paper currency fed through the slot 38 passes over the thumbwheel 40 and over the inlet ramp 56 towards the interior compartment 44. The inlet ramp 56 progressively restricts the size of the slot 38 so that paper currency may pass with relative ease toward the interior compartment. However, once inside the interior compartment 44, folded currency will tend to expand, and the absence of an inclined segment adjacent to the interior compartment 44 serves to prevent said currency from passing out of the interior compartment 44 through the slot 38.

Figure 4:
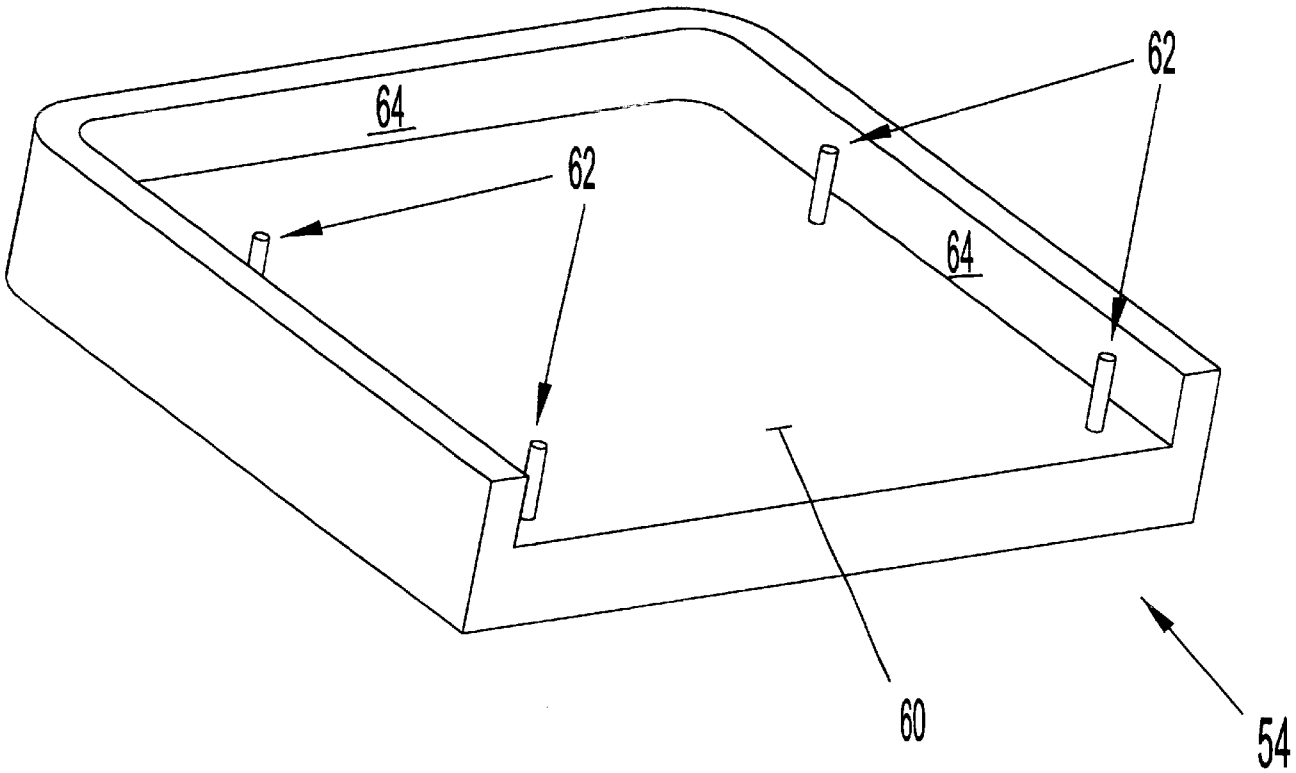
FIG. 4 is a perspective view of a key used to access the preferred embodiment of the portable currency storage device.

A key 54 is provided as in FIG. 4, comprising a body 60 and a series of fixed pins 62 projecting therefrom. Operation of the key 54 is best understood with reference to FIGS. 2 and 4 together, recognizing that FIG. 4 is oriented to expose the operable surface and must be mentally inverted to properly align with the depiction of FIG. 2. The fixed pins 62 are oriented to simultaneously project into each of the holes 42 of the cover 22 when the body 60 is place flush against the cover top surface 24. Assuming the holes 42 have a depth d, the fixed pins 62 project from the body 60 a similar length d, such that when the key 54 is placed against the cover top surface 24, each fixed pin 62 depresses one retractable pin 52. Since the depth of the holes 42 substantially equals the length that the fixed pins 62 extend from the body 60, the retractable pins 52 are retracted enough to allow the cover 22 and base 30 to be slideably disengaged.

FIG. 4 shows an optional raised lip 64 on three sides of the body 60. This raised lip 64 serves dual purposes. First, it aids in aligning the fixed pins 62 of the key 54 with the holes 42 of the cover 22, by partially enveloping three sides of the cover 22. Second, it protects the fixed pins 62 from being inadvertently bent, because the raised lip 64 extends slightly higher than the length d of the fixed pins 62.

The preferred embodiment described above employs an aluminum cover, base, and key, with steel retractable pins. The above embodiment is illustrative rather than exhaustive. Various substitutions of components described herein will be obvious to skilled artisans in light of the above teaching, such as employing high impact plastic for several component parts, substituting an alternative locking mechanism for the retractable pin/hole arrangement, or employing a battery driven thumbwheel that may or may or penetrate the cover top surface. The preferred embodiment employs cylindrical shaped projections as the pins, but the term 'pins' as used herein includes projections having various cross sections (i.e. square, rectangular, ocatagonal, etc.). The scope of the following claims encompass such modifications and variations in accordance with the doctrine of equivalents.

I claim:

1. A portable device for holding paper currency, comprising:

a base and a cover being moveable relative to one another and defining an interior compartment;

a slot defined by the base and cover wherein the slot is in communication with the interior compartment;

a reusable locking mechanism to prevent movement of said base relative to said cover; and escapement means obstructing the slot but receiving the paper currency into said interior compartment at least when the locking mechanism prevents movement of the base relative to the cover; wherein the escapement means serves the additional function of inhibiting removal of the paper currency from the interior compartment.

2. The device of claim 1 wherein said base and cover are slidably engagable with one another.

3. The device of claim 1 wherein said locking mechanism comprises a retractable pin on one of said cover or base that engages a complementary hole in the other of said cover or base.

4. The device of claim 3 wherein said locking mechanism retractable pin is biased toward an extended position such that it normally extends into the complementary hole when said cover and base are assembled.

5. The device of claim 4 wherein said cover and said base are moveable relative to one another after said locking mechanism prevents movement of the base relative to the cover only when the retractable pin is moved to at least a partially retracted position.

6. The device of claim 1 wherein said escapement means is adapted to receive the paper currency when the paper currency is folded.

7. The device of claim 1 wherein said escapement means includes an inlet ramp projecting into the slot.

8. The device of claim 1 sized to fit into a purse, a pocketbook, or a pocket in an article of clothing.

9. The device of claim 1 wherein said escapement means includes an inlet ramp defining an inclined segment that facilitates entry of the paper currency into the interior compartment and restricts the paper currency in the interior compartment from being removed.

10. A portable device for holding paper currency, comprising:

a base and a cover being moveable relative to one another and defining an interior compartment;

a locking mechanism to prevent movement of said base relative to said cover, said locking mechanism comprising at least one retractable pin on said cover or base that engages a complementary hole in the other of said cover or base, said retractable pin biased toward an extended position such that it normally extends into said complementary hole when said cover and base are assembled;

escapement means for receiving the paper currency into said interior compartment; and a key to unlock the portable device and allow access to the paper currency, said key having a body and at least one projection therefrom adapted to depress said retractable pin of said device when said body is placed on said base or cover.

11. The key of claim 10 wherein said body is generally rectangular and said projection is a fixed pin provided adjacent to a comer of said body.

12. A portable device for holding paper currency, comprising:

a base and a cover being moveable relative to one another and defining an interior compartment;

a locking mechanism to prevent movement of said base relative to said cover; and escapement means for receiving the paper currency, said escapement means including a thumbwheel partially projecting into a slot, said slot being in communication with said interior compartment and exterior of said portable device.

13. The device of claim 12 wherein said thumbwheel is manually operated.

14. The device of claim 12 wherein said escapement means further comprises an inlet ramp positioned between said thumbwheel and said interior compartment, said inlet ramp having a geometry that inhibits the removal of the paper currency through said slot from said interior compartment.

15. A device for holding paper currency, comprising:

a base having a plurality of retractable pins extending therefrom, said pins biased to an extended position;

a cover adapted to be slideably received by said base, and defining holes extending through said cover to receive said retractable pins when said base and said cover are slideably engaged, said retractable pins extending into said holes and preventing said base and said cover from slideably disengaging, said base and said cover defining an interior compartment adapted to receive the paper currency and further defining a slot through which the paper currency may enter said interior compartment from exterior of said device; and a key having fixed pins extending therefrom and adapted to extend through said holes to simultaneously urge said retractable pins toward a position that allows said base and said cover to be slideably disengaged from each other.

16. The device of claim 15 further comprising a thumbwheel for drawing the paper currency through said slot toward said interior compartment.

17. The device of claim 16 further comprising means to restrict the paper currency from being withdrawn through said slot from said interior compartment.

18. A device for holding paper currency, comprising:

a base and a cover slidably engagable with one another and when closed together defining an interior compartment;

a slot defined by the base and the cover wherein the slot is in communication with the interior compartment and exterior of the device when the base and cover are closed;

at least one receptacle defined by one of the base or cover; and at least one retractable pin extending from the other of the base or cover, wherein the pin is aligned with the receptacle when the base and cover are closed, and the pin is further biased toward an extended position so as to be received in the receptacle when the base and cover are closed;

the device sized to fit within a purse, a pocketbook, or a pocket in an article of clothing.

* * * * *

UNITED STATES PATENT AND TRADEMARK OFFICE

CERTIFICATE OF CORRECTION

PATENT NO. : 6,450,400 B1
DATED : September 17, 2002
INVENTOR(S) : Roland D. Savoir, Jr.

It is certified that error appears in the above-identified patent and that said Letters Patent is hereby corrected as shown below:

Column 4,
Line 3, after "a" please delete "comer" insert -- corner --.

Signed and Sealed this

Twenty-eighth Day of January, 2003

JAMES E. ROGAN
*Director of the United States Patent and Trademark Office*